United States Patent [19]

Giglio

[11] Patent Number: 4,852,191

[45] Date of Patent: Aug. 1, 1989

[54] TOILET

[76] Inventor: Felicino Giglio, 1624 Kimball St., Brooklyn, N.Y. 11234

[21] Appl. No.: 194,880

[22] Filed: May 17, 1988

[51] Int. Cl.[4] ..... E03D 9/03

[52] U.S. Cl. ..... 4/228; 4/227; 4/364; 4/382

[58] Field of Search ..... 4/224, 228, 222, 223, 4/225, 226, 227, 364, 355, 356, 363, 364, 365, 381, 382, 391, 392, 394, 395

[56] References Cited

U.S. PATENT DOCUMENTS

| | | | |
|---|---|---|---|
| 393,110 | 11/1888 | Hubert | 4/364 |
| 524,176 | 8/1894 | Liming | 4/394 |
| 575,930 | 1/1897 | Morell | 4/364 |
| 977,990 | 12/1910 | Wise | 4/228 |
| 1,688,098 | 10/1928 | Turner | 4/227 |
| 2,207,363 | 7/1940 | Vipond | 4/227 |
| 3,080,571 | 3/1963 | Valerioti et al. | 4/228 |
| 3,084,350 | 4/1963 | Anderson | 4/225 |
| 4,143,430 | 3/1979 | Joshi et al. | 4/364 |
| 4,663,786 | 5/1987 | Kirkpatrick | 4/228 X |

FOREIGN PATENT DOCUMENTS

| | | | |
|---|---|---|---|
| 13192/28 | 5/1928 | Australia | 4/227 |
| 4404 | of 1907 | United Kingdom | 4/228 |

*Primary Examiner*—Henry J. Recla
*Assistant Examiner*—Daniel Stein-Freer
*Attorney, Agent, or Firm*—Michael I. Kroll

[57] ABSTRACT

An improved toilet with a bowl and a flusher wherein the improvement includes a toilet water tank which contains an insert for creating a first compartment filled with a deodorant and a second compartment filled with a fluid, and an actuator which is pivotally mounted on the insert and has an opened position for allowing a predetermined amount of the deodorant to pass from the first compartment into the second compartment and a closed position for preventing the deodorant from passing from the first compartment into the second compartment so that when the actuator is in the opened position the predetermined amount of the deodorant passes from the first compartment into the second compartment and mixes with the fluid in the second compartment to provide deodorizing for the toilet.

8 Claims, 2 Drawing Sheets

TOILET

BACKGROUND OF THE INVENTION

1. Field of the Invention

The present invention relates to a toilet. More particularly, the present invention relates to a toilet which has a bowl and flushing means.

2. Description of the Prior Art

Toilets of the above-mentioned general type are known in the art. One such toilet is disclosed, for example, in a toilet wherein when the chain attached to the lever of the flushing cistern is pulled, as shown in FIG. 1, the hollow iron bell-shaped unit rises and opens the passage to the flush pipe. As soon as water flows down the flush pipe, a vacuum is formed in the cavity of the bell causing more water to flow from the cistern through the bell and down the flush pipe.

The cavity inside the bell thus acts as a siphon, as shown in FIG. 2. When a vacuum is formed at C, by the initially applied suction, water is drawn through the siphon tube. Once the flow has been started, it will continue. For the siphon to function, its outlet must always be below the level of water in the tank.

When the chain of the water closet has been briefly pulled and released, the bell falls back into position over the inlet of the flush pipe, but the flow of water still continues, due to the siphon effect, until the cistern has been drained. As the water level in the cistern goes down, the float descends and opens the water supply valve, so that the cistern fills up again. When the float has risen to a certain level, the incoming water is cut off by the valve.

Another such tiolet is disclosed, for example, in a toilet wherein when the rod is briefly pulled up and then released, as shown in FIG. 3, the water continues to flow until the cistern is drained. The rod is provided with a freely movable float which is prevented from floating to the surface of the water by two stops on the pull rod. When the rod is raised and the inlet of the flush pipe is opened, the closing pressure, which is developed by the water column in the full tank, is reduced. The buoyancy of the float predominates and keeps the pipe inlet open. The rod then descends and the rubber valve disc is thrust against its seat by the incoming water.

Various toilet deodorants are known in the art. One such toilet deodorant is disclosed, for example, in a toilet deodorizer that is contained in a plastic container which is snapped on to the rim on the left side of the bowl. It is imperative that the container fit snugly against the side of the bowl. The toilet is then flushed and the container must be manually moved along the rim of the bowl to assure that water flows directly over the container. However, if the deodorizer is not wearing evenly, the container must be moved to a different position, preferably to the opposite side of the bowl.

Another such toilet deodorant is disclosed, for example, in a toilet deodorizer that is contained in a bottle which is installed upside down in the toilet tank. Before the bottle is clipped to the inside tank wall, it must first be held upright over water so that the bottom clip may be pushed out and the green ribbed outer cap removed. However, it is imperative that the water level in the tank reach above the bottle opening, and that the contents of the bottle do not touch the eye, skin or clothing.

Another such toilet deodorant is disclosed, for example, in a toilet deodorizer that is contained in a cup which is installed in the toilet tank. However, the toilet bowl must first be cleaned thoroughly, the toilet flushed, and the tank evacuated of water before the cup is placed on the bottom of the toilet tank. In order to dispose of the cup, the toilet must be flushed and the cap removed before the tank refills. It is imperative that any excess water be drained into the tank and that the plastic cup be disposed of properly in a plastic bag. The contents of the cup must not be spilled on the floor, on fabrics or come in contact with the eyes, skin or mucous membranes. Additionally, the cup must be tightly closed and stored away from metals and fabrics.

Another such toilet deodorant is disclosed, for example, in a toilet deodorizer that is contained in a unit which is installed in the toilet tank. The unit must be extended to full length and placed in the center rear of the tank so that the unit rests on the tank bottom when it is hooked onto the tank wall. However, it is imperative that the unit be placed free of any moving parts and that the tank water level must fall below the bottom hole of the unit when the toilet is flushed. If the tank water level does not fall below the bottom hole of the unit when the toilet is flushed, the unit must be raised up until the water level in the tank at its lowest point falls below the bottom hole of the unit. Additionally, the deodorizer must not come in contact with the skin, eyes or be ingested.

The capacity of the flushing cistern is approximately two gallons. Nearly half the water used in an average household flows through the toilets that require deodorizing.

It can be seen that the prior art devices possess numerous disadvantages. Additionally, the prior art devices fail in their attempt to provide a single compact integral unit that both conserves water and deodorizes a toilet.

SUMMARY OF THE INVENTION

Accordingly, it is an object of the present invention to provide an improved toilet which avoids the disadvantages of the prior art.

More particularly, it is an object of the present invention to provide an improved toilet which is simple and easy to use, economical in cost to manufacture, and in one simple operation conserves water while deodorizing itself.

In keeping with these objects, and with others which will become apparent hereinafter, one feature of the present invention resides, briefly stated, in an improved toilet which has a bowl and flushing means wherein the toilet water tank contains an insert for creating a first compartment filled with a deodorant and a second compartment filled with a fluid, and actuating means are pivotally mounted on the insert and have an opened position for allowing a predetermined amount of the deodorant to pass from the first compartment into the second compartment and a closed position for preventing the deodorant from passing from the first compartment into the second compartment.

When the improved toilet is designed in accordance with the present invention, a predetermined amount of the deodorant passes from the first compartment into the second compartment and mixes with the fluid in the second compartment to provide for deodorizing of the toilet when the pivot means is in the opened position.

In accordance with another feature of the present invention, the deodorant is a liquid.

Another feature of the present invention is that the fluid is water.

Yet another feature of the present invention is that the insert contains a gate.

Still another feature of the present invention is that the gate is a throughbore.

Yet still another feature of the present invention is that the first compartment has a wedge shaped bottom that slants downwardly towards the insert and terminates on the lowermost portion of the gate so that all of the deodorant can leave the first compartment, pass through the gate, and enter the second compartment in the predetermined amounts upon demand.

Still yet another feature of the present invention is that the actuating means include a first rod having an end and a second rod having an end.

Another feature of the present invention is that the actuating means further include a float disposed on the end of the first rod and a seal disposed on the end of the second rod.

Yet another feature of the present invention is that the seal mates with the gate contained in the insert.

Finally still a further feature of the present invention is that the seal is a rubber washer.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS

Figure 1:
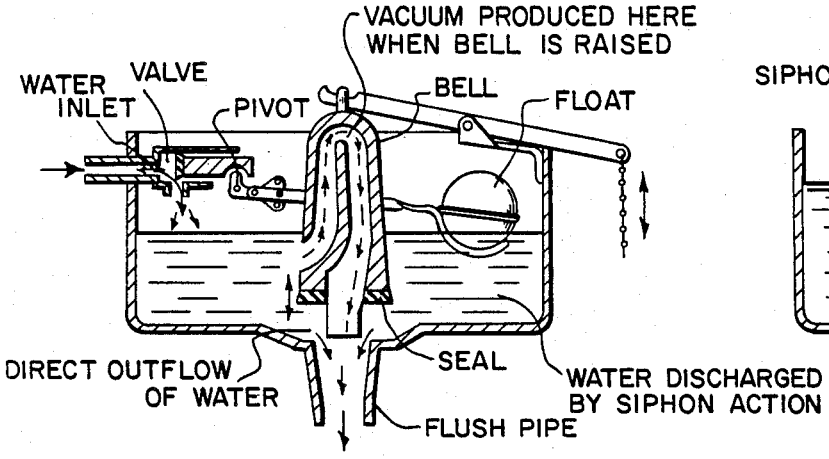
PRIOR ART Figure 1
FIG. 1 is a side view of a first prior art type cistern.
Figure 2:
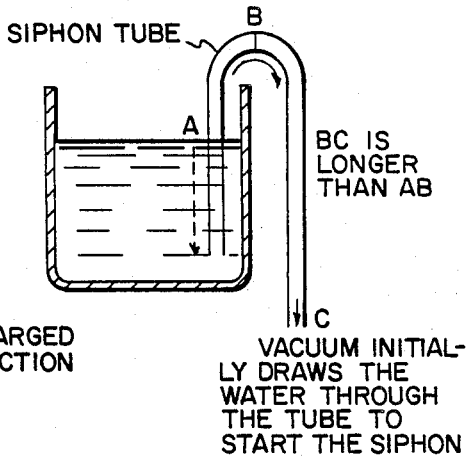
PRIOR ART Figure 2
FIG. 2 is a diagram of how prior art type cisterns siphon.
Figure 3:
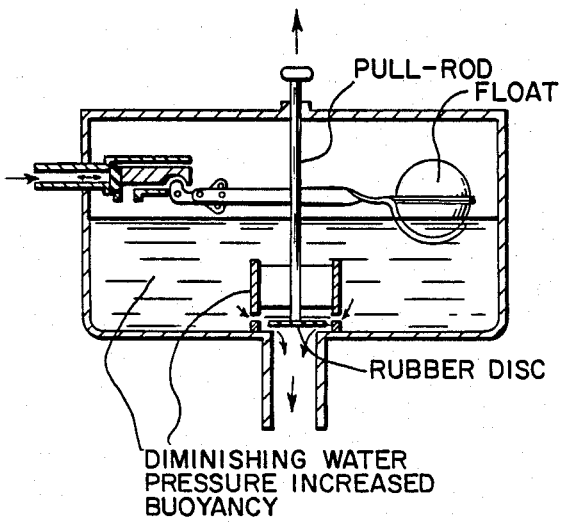
PRIOR ART Figure 3
FIG. 3 is a side view of a second prior art type cistern.

10. improved toilet
12. bown
14. shut-off valve
16. tank
18. first compartment
20. second compartment
22. deodorant
24. fluid - (water)
25. conventional flushing means
26. insert
30. flat rectangular body
32. side
34. side
36. bottom
38. float actuator means
39. tongue portion
40. gate
42. flange
44. flange
46. slot
48. slot
50. throughbore
52. throughbore
54. full nternal wall
56. "U"-shaped internal wall
58. groove portion
59. tongue and groove joint
60. shaft
62. first rod
64. free end
66. second rod
68. free end
70. float
72. seal
74. robber washer
76. bottom panel

DETAILED DESCRIPTION OF THE PREFERRED EMBODIMENT

Figure 4:
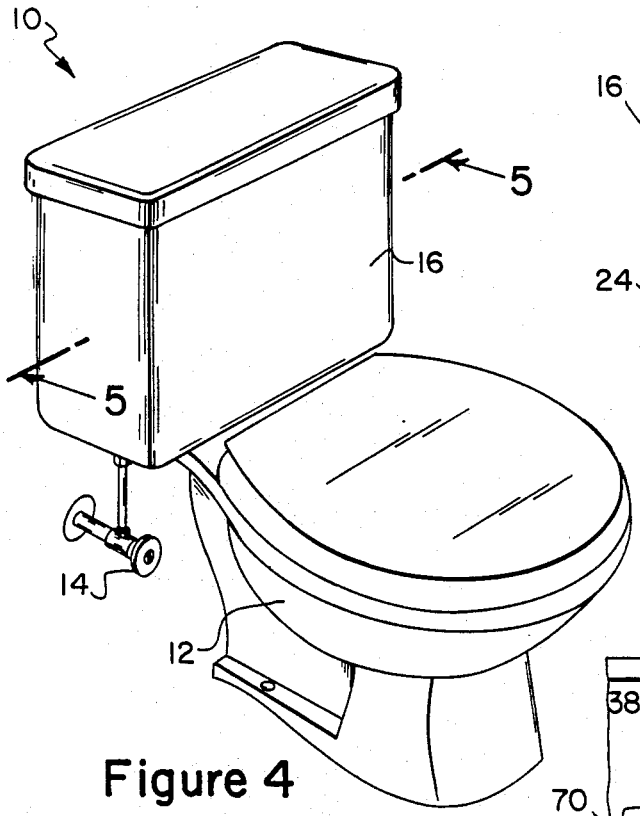
FIG. 4 is a perspective view of a tank toilet.

Referring now to FIG. 4, the improved toilet of the present invention is shown generally at 10 and includes a bowl 12, a shut off valve 14, and a tank 16. As shown, the external appearance of the improved toilet 10 is identical to that of a conventional tank toilet since the improvement lies within the tank 16.

Figure 6:
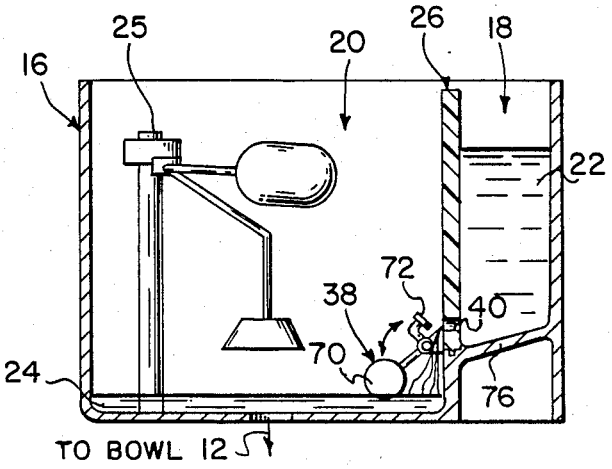
FIG. 6 is a sectional view taken along line 5—5 of FIG. 4 and showing the present invention in the opened position.
Figure 5:
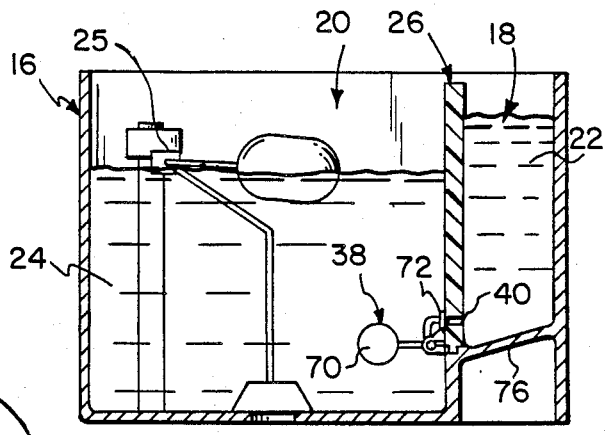
FIG. 5 is a sectional view taken along line 5—5 of FIG. 4 and showing the present invention in the closed position.

As shown in FIGS. 5 and 6, the tank 16 contains a first compartment 18 and a second compartment 20. The first compartment 18 contains a deodorant 22 which is preferably a liquid, but is not limited to it. The second compartment 20 contains a fluid 24 which is preferably water, but is not limited to it. The second compartment 20 further contains conventional flushing means 25. An insert 26 provides a barrier between the first compartment 18 and the second compartment 20 and pivotally supports float actuator means 38. The insert 26 is preferably molded from the thermoplastic material that remains stable for long immersions in the water 24, but is not limited to it.

Figure 7:
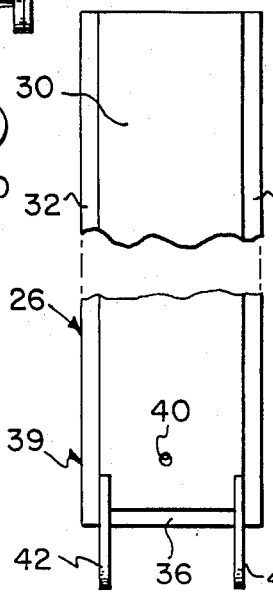
FIG. 7 is a front view of the insert of the present invention shown in FIGS. 5 and 6.
Figure 8:
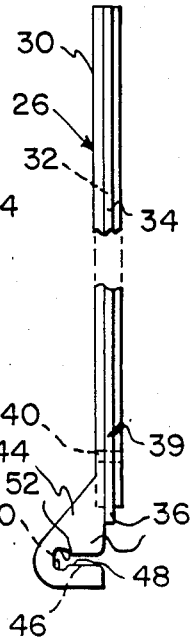
FIG. 8 is a side view of the insert of the present invention shown in FIGS. 5, 6 and 7.

As shown in FIGS. 7 and 8, the insert 26 is a flat rectangular body 30 with sides 32 and 34 and a bottom 36. The sides 32 and 34 and the bottom 36 of the insert 26 form a continuous tongue portion 39 of a tongue and groove joint. The insert 26 contains a gate 40 which is preferably a throughbore, but is not limitd to it. On the bottom 36 of the insert 26, and inboard of the vertical sections of the tongue portion 39, are disposed a pair of flanges 42 and 44. The flanges 42 and 44 contain slots 46 and 48, respectively, which terminate in throughbores 50 and 52, respectively.

Figure 9:
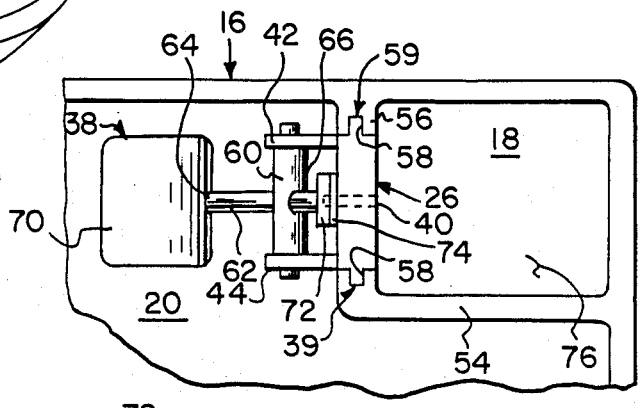
FIG. 9 is a top view of the tank showing the float actuator means of the present invention shown in FIGS. 5 and 6.
Figure 10:
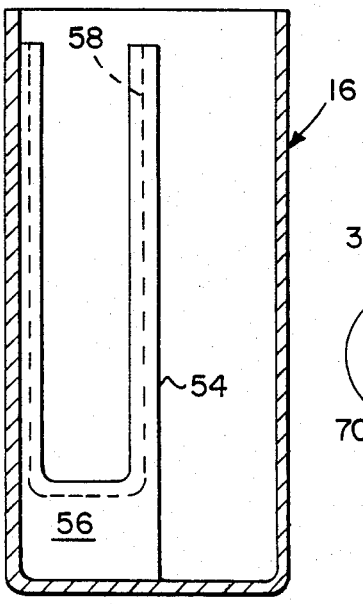
FIG. 10 is a side view of the tank of the present invention shown in FIGS. 5, 6 and 9 with the insert removed.

As shown in FIGS. 9 and 10, the tank 16 includes a full internal wall 54 and a mutually perpendicular "U"-shaped internal wall 56. The full internal wall 54 and the mutually perpendicular "U"-shaped internal wall 56 are preferably molded with the tank 16, but are not limited to it. The "U"-shaped internal wall 56 contains an internal "U"-shaped relief which forms a contniuous groove portion 58 of a tongue and groove joint.

Specifically, as shown in FIG. 9, the tongue portion 39 of the insert 26 mates with the groove portion 58 of the internal "U"-shaped internal wall 56 and forms a tongue and groove joint 59. The tongue and groove joint 59 allows the insert 26 to sealingly separate the first compartment 18 from the second compartment 20.

Figure 11:
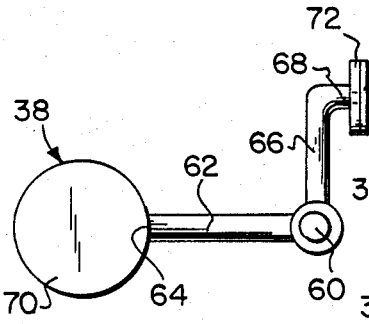
FIG. 11 is a side view of the float actuator means of the present invention shown in FIGS. 5, 6 and 9.

As shown in FIG. 11, the float actuator means 38 includes a shaft 60. A first rod 62 having a free end 64 and a second rod 66 having a free end 68 extend substantially mutually perpendicular to each other and from the shaft 60. A float 70 is disposed on the free end 64 of the first rod 62 and a seal 72, which is preferably a rubber washer 74 but is not limited to it, is disposed on the free end 68 of the second rod 65. The float 70 is preferably molded from a buoyant thermoplastic material that remains stable for long immersions in the water 24, but is not limited to it. The seal 72 is preferably molded from a flexible material that remains stable for long immersions in the water 24, but is not limited to it.

Returning now to FIGS. 5 through 9, the float actuator means 38 is pivotally mounted to the insert 26 by sliding the shaft 60 into the slots 46 and 48 of the flanges 42 and 44, respectively, until the shaft 60 reaches the throughbores 50 and 52 of the flanges 42 and 44, respectively, where it is seated. With this arrangement, the seal 72 can sealingly mate with the gate 40.

Still referring to FIGS. 5, 6, and 9, the first compartment 18 is further defined by a bottom panel 76 which is substantially wedge shaped, converging downwardly towards the gate 40, and terminating at the lowermost portion of the gate 40. The bottom panel 76 is so formed so that all of the deodorant can leave the first compartment 18, pass through the gate 40, and enter the second compartment 20 upon demand.

In operation, as specifically shown in FIG. 5, the second compartment 20 fills with the water 24, as in a conventional tank toilet. As the second compartment 20 fills with the water 24, the float 70 rises and causes the seal 72 to close the gate 40. With the gate 40 closed, the first compartment 18 is filled with the deodorant 22.

As specifically shown in FIG. 6, when the flusher 25 is operated in the conventional manner, the water 24 leaves the second compartment 20 and enters the bowl 12. As the level of the water 24 in the second compartment 20 drops below the float 70, the float will lower and cause the seal 72 to depart from the gate 40. With the gate 40 opened, a predetermined amount of the deodorant 22 will leave the first compartment 18 and enter the second compartment 20. The deodorant 22 will continue to flow until the level of the water 24, that is refilling the tank, causes the float 70 to rise and causes the seal 72 to mate with the gate 40 which will stop the flow of the deodorant 22, as is shown in FIG. 5. When the flusher 25 again operates, the cycle will repeat.

The strategic locations of the gate 40 and the flanges 42 and 44, and the specific lengths of the first rod 62 and the second rod 64, define the predetermined amount of the deodorant 22 that passes from the first compartment 18 into the second compartment 20 during each cycle.

It will be understood that each of the elements described above, or two or more together, may also find a useful application in other types of constructions differing from the type described above.

While the invention has been illustrated and described as embodied in an improved toilet, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An improved toilet having a bowl and flushing means wherein the improvement comprises:

a toilet water tank having a removable partition transversly mounted in said tank and dividing said tank into a first compartment filled with a deodorant and a second compartment to be filled with a flushing fluid, said partition having an aperture adjacent the lower end thereof, first valve means in said second compartment for flushing fluid from said second compartment through said toilet bowl, and for replenishing fluid in said second comparment, and second valve means mounted on said partition and disposed within said second compartment at a lower end therof, for closing said aperture, said valve means including actuating means responsive to fluid level in said second compartment wherein said aperture is opened when said fluid level drops to a predetermined level in said second compartment for allowing a predetermined amount of said deodorant to pass from said first compartment into said second compartment and a closed when a predetermined level of flushing fluid is replenished in said second compartment for preventing said deodorant from passing from said first compartment into said second compartment whereby said deodorant mixes with said fluid in said second compartment when the level of said flushing fluid is near the lower end thereof to provide deodorizing for the toilet.

2. An improved toilet as defined in claim 1, wherein said deodorant is a liquid.

3. An improved toilet as defined in claim 1, wherein said fluid is water.

4. An improved toilet as defined in claim 1, wherein said first compartment has a wedge shaped bottom that slants downwardly towards said partition and terminates near said aperture so that all of said deodorant can leave said first compartment, pass through said gate, and enter the second compartment in said predetermined amount upon demand.

5. An improved toilet as defined in claim 1, wherein said actuating means include a first rod having an end and a second rod having an end.

6. An improved toilet as defined in claim 5, wherein said actuating means further includes a float disposed on said end of said first rod and a seal disposed on said end of said second rod.

7. An improved toilet as defined in claim 4, wherein said seal mates with said aperture contained in said partition.

8. An improved toilet as defined in claim 4, wherein said seal is a rubber washer.

* * * * *